United States Patent [19]

Cutler

[11] 4,011,023

[45] Mar. 8, 1977

[54] ASPHALT PAVEMENT RECYCLING APPARATUS

[75] Inventor: Earl F. Cutler, Lawrence, Kans.

[73] Assignee: Cutler Repaving, Inc., Lawrence, Kans.

[22] Filed: Dec. 15, 1975

[21] Appl. No.: 640,444

[52] U.S. Cl. ..... 404/91

[51] Int. Cl.[2] ..... E01C 23/12

[58] Field of Search ..... 404/91, 92, 75, 84, 404/77, 79; 427/138, 139; 259/161, 162

[56] References Cited

UNITED STATES PATENTS

| | | | |
|---|---|---|---|
| 1,041,226 | 10/1912 | Ames | 404/80 X |
| 1,205,948 | 11/1916 | Popkess | 404/91 |
| 2,254,463 | 9/1941 | Wells | 404/95 |
| 2,257,637 | 9/1941 | Moore | 404/95 X |
| 2,394,017 | 2/1946 | Seaman | 404/91 |
| 3,285,147 | 11/1966 | Gruvris | 404/95 X |
| 3,361,042 | 1/1968 | Cutler | 404/77 |
| 3,372,626 | 3/1968 | Smarzak | 404/91 X |
| 3,678,817 | 7/1972 | Martenson | 404/84 X |
| 3,699,855 | 10/1972 | Leister | 404/84 |
| 3,843,274 | 10/1974 | Gutman | 404/91 |

*Primary Examiner*—Nile C. Byers
*Attorney, Agent, or Firm*—Olson, Trexler, Wolters, Bushnell & Fosse, Ltd.

[57] ABSTRACT

A machine for recycling macadam highway pavement is disclosed. A pickup device removes crumbled pavement material from a roadbed site, and heaters heat the material as it passes through the machine. An applicator applies liquid asphalt to the material to form a rejuvenated mix. Simultaneously, roadbed heaters heat the roadbed site, and an applicator applies liquid asphalt. A spreader spreads the mix on the roadbed site, and adjustable screeds preliminarily form the spread mix for final working into a finished road.

21 Claims, 4 Drawing Figures

ASPHALT PAVEMENT RECYCLING APPARATUS

BACKGROUND OF THE INVENTION

This invention relates generally to road construction equipment and more particularly concerns equipment for reconstructing or recycling macadam roads and highways.

Macadam highways have been extensively built in recent years. In general, these highways are laid over a base which can include a substructure and in some instances a final course of concrete. In its upper strata, the highway includes a macadam top surface formed of stone or gravel aggregate bound firmly together by a bituminous bonding agent such as asphalt.

Such roads provide a relatively trouble-free, permanent surface. Inevitably, however, the passage of time and traffic and the impingement of weather causes this macadam surface to become brittle and crack. Where concentrated cracking occurs, pieces of pavement may become dislodged. This dislodgment can create traffic hazards, and accelerates the deterioration of adjacent pavement and the highway substructure. Even if cracking does not occur, the passage of traffic can polish the upper highway surface, and a polished, slippery highway surface may be dangerous.

In addition, traffic-caused wear can groove or trough a highway surface. Under wet highway conditions, water can collect in these troughs and set up dangerous vehicle hydroplaning phenomena.

Repairing these deteriorated highways and roads can be an expensive and difficult task. Road resurfacing apparatus used to reconstruct or recycle these highways are disclosed in U.S. Pat. Nos. 3,361,042, 3,724,445, 3,807,886 and 3,874,366. While these devices have met with commercial success, it has until now proved impractical to physically remove and rejuvenate recycle the upper macadam strata of deteriorated highways.

It is accordingly the general object of the present invention to provide apparatus for recycling macadam highways, airport runways or the like. A related object is to provide such apparatus which will accomplish this recycling activity rapidly and at minimum cost.

Another object is to provide highway recycling apparatus which will provide a new, smooth, crack-free, safe and long lasting highway surface.

Another object is to provide apparatus for repaving a macadam highway which uses, as a major ingredient of the new pavement, the original deteriorated highway pavement material.

Yet another object is to provide recycling apparatus which minimizes labor requirements.

Other objects and advantages of the invention will become apparent upon reading the following detailed description and upon reference to the drawings. Throughout the drawings, like reference numerals refer to like parts.

DETAILED DESCRIPTION

Figure 1:
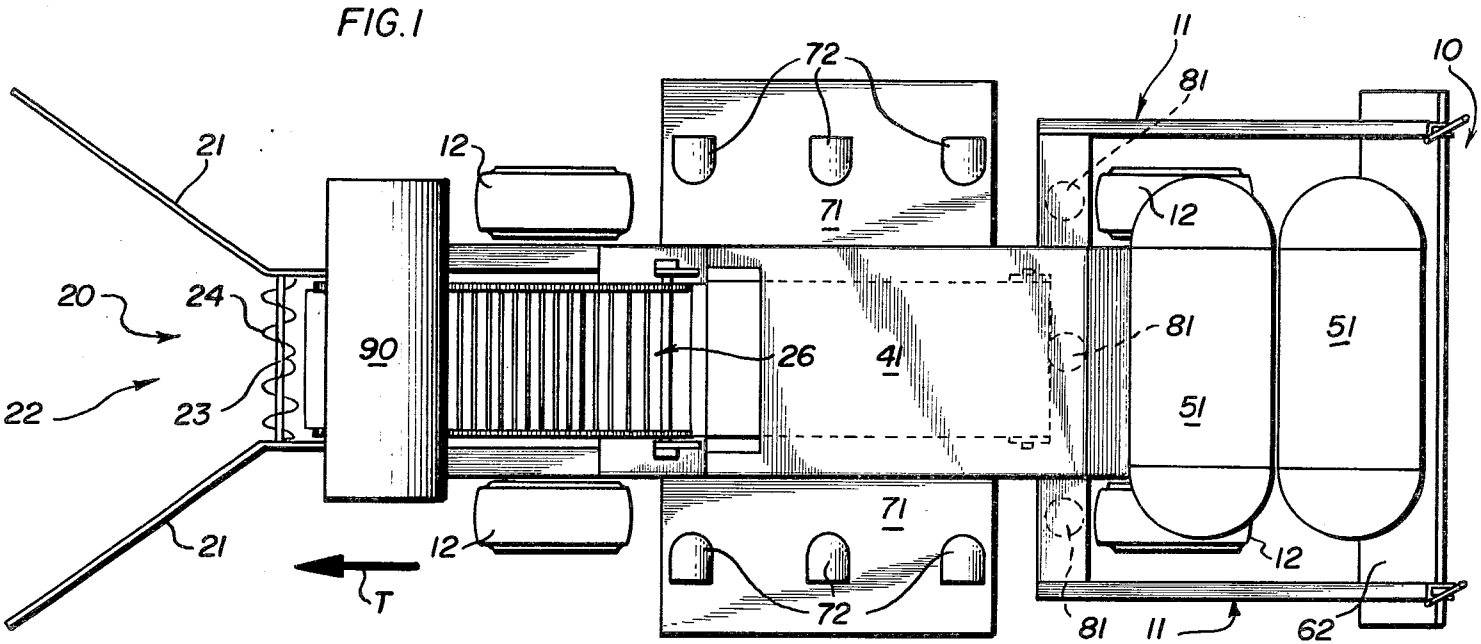
FIG. 1 is a top plan view of equipment embodying the present invention.

While the invention will be described in connection with a preferred embodiment and procedure, it will be understood that it is not intended to limit the invention to this embodiment and procedure. On the contrary, it is intended to cover all alternatives, modifications and equivalents as may be included within the spirit and scope of the invention as defined by the appended claims.

Turning more particularly to the drawings, there is shown equipment or a machine 10 embodying the present invention. In general, it is contemplated that this machine will include a frame 11 mounted upon wheels 12 for motion over a highway 13. The upper strata of this highway 13 comprises a deteriorated macadam material 14. Here, it is contemplated that this deteriorated material 14 has been scarified or dislodged from a highway undersurface 15 by any of a number of planing machines or other appropriate equipment available to accomplish this task. If desired, the entire upper strata which can be two to three or more inches thick, can be dislodged and crumbled by road surface breaking machinery. This macadam material 14, now crumbled and lying loose upon the undersurface 15, is encountered by the novel recycling machine 10 as it moves over the highway. The material 14 is used as a major ingredient of a new material and asphalt mix 17 which is spread by the machine 10.

In accordance with the general aspects of the invention, highway recycling or reconstruction is accomplished by picking up the crumbled pavement material 14 from its roadbed site 15 by pickup apparatus 20 and then delivering it to a conveyor device 30. As the crumbled pavement material 14 moves through the conveyor structure 30, it is heated by a heater 40. At an intermediate point, a liquid applicator 50 sprays or otherwise applies a liquid asphalt to the heated, crumbled pavement material 14. After further heating, the crumbled pavement material and asphalt mix is then spread upon the original roadbed site 15 by a spreader mechanism 60. Simultaneously with this activity, the roadbed site 15 itself, from which the crumbled pavement material 14 has been picked up, is heated by a roadbed heater 70, and liquid asphalt is applied to the site by an asphalt applicator 80. An engine 90 supplies power for driving the various conveyors and other apparatus, and for propelling the machine 10 along the highway 13.

Again in connection with the general aspects of the invention, the pickup 20, conveyors 30, crumbled material heaters 40, material asphalt applicator 50, spreader 60, roadbed site heaters 70, and roadbed asphalt applicator 80 are all mounted upon the common frame 11 of the machine 10. Thus, all this apparatus can be moved on and over the roadbed site 15 so as to spread the new crumbled pavement material and asphalt mix 17 on the roadbed site 15 in substantially the same place as that from which the crumbled pavement material 14 was picked up.

More specifically now, the broken or crumbled pavement material 14 is first encountered by diagonally disposed collector or gathering arms 21 located at the fore-end 22 of the machine 10. These arms 21 urge the dispersed material 14 into a windrow as the machine travels forward in the direction indicated by the arrow T in FIGS. 1 and 2. An auger 23 is provided with opposite-handed flights 24 which operate to further centralize the crumbled material 14. The material, now windrowed, is engaged by flights 25 of a pickup or first conveyor 26. As is illustrated here, this material can be expeditiously yet economically moved to an elevated position at the top of the machine by disposing the conveyor flights 25 so as to drag the material 14 along at inclined pickup elevator surface 27. Heaters 28 can be disposed within the first conveyor 26 to preliminarily heat the crumbled material 14. In the illustrated embodiment, this conveyor 26 comprises a chain 29; it will be understood, however, that other conveyor devices providing effective material moving action and long service life can be used.

As the aggregate material 14 reaches the machine top, it is dispensed upon the fore-end of the centralized or second conveyor mechanism 30. This conveyor 30 here includes a preliminary conveyor 31 beneath which is mounted a load sensor 32 adapted to sense the weight of the crumbled material 14 passing through the machine, and to transmit this weight information to a control apparatus 43 of known construction.

This control apparatus 43 can be interconnected in known manner to the weight sensor 32 and to a speed sensor such as a conveyor belt idler pulley 44 so as to increase or decrease the liquid asphalt flowing through a control valve 45, and apply an amount of asphalt in predetermined relation to the weight of the pavement material falling and tumbling from a first conveyor reach 34 to a second reach or flight 37. If desired, a scraper 33 can be provided to insure removal of the heated and crumbled material 14 from the preliminary conveyor 31.

Material 14 from the preliminary conveyor 31 is dropped, in the illustrated embodiment, upon an upper or first reach 34 of a processing conveyor 35 also included in the second conveyor system.

As the material moves along this first reach 34, the temperature of the material 14 is further raised by heaters 40 which are disposed adjacent the path of movement. Again, material loss can be minimized and machine operating economy maximized by sliding both the conveyor reach 34 and the material 14 itself over an appropriate carrying surface 36.

It is a feature of the invention that liquid asphalt, heated to an appropriate temperature by apparatus not shown, is applied to this heated and crumbled material 14. To this end, the liquid asphalt applicator 50 is conveniently located at the downstream end of the first conveyor reach 34. The liquid asphalt applied by the applicator 50 can be stored in reservoirs 51 which are conveniently mounted upon the frame 11 and which are maintained at a suitably elevated temperature. After passing the applicator 50, the crumbled material 14, now preliminarily coated with liquid asphalt, drops from the upper conveyor flight 34 to the fore-end of a lower conveyor flight or reach 37 which is arrayed vertically beneath the upper flight 34. In undergoing this drop, the crumbled pavement material is tumbled and agitated so as to encourage the pavement material to be completely covered with liquid asphalt.

It is a feature of the invention that the amount of asphalt applied by the applicator 50 is controlled in relation to the weight of the crumbled pavement material sensed by the sensor 32. This can be accomplished by the control apparatus mentioned above. Use of this system assists in providing a recycled pavement of high quality at low cost.

When the material and asphalt mix is caught by the lower or second conveyor flight 37, the mix is moved along a carrying surface 38 past radiant heaters 40 which raise the temperature of the crumbled material and asphalt mix to a further elevated degree. This additional heating lowers asphalt viscosity and further encourages completely covering the crumbled pavement material 14 with the asphalt. If desired, an enclosing hood 41 can be employed to retain the radiant heat applied to this material 14 and mix 17 and to confine any fumes or gases within the machine 10.

Figure 2:
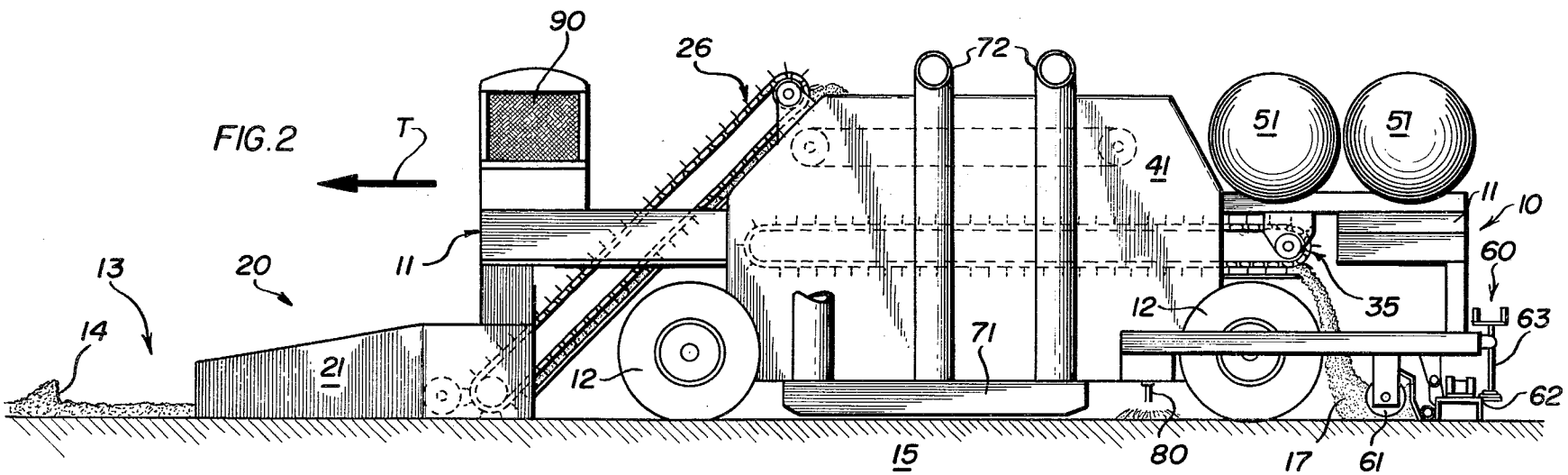
FIG. 2 is a side elevational view of the equipment shown in FIG. 1.
Figure 3A:
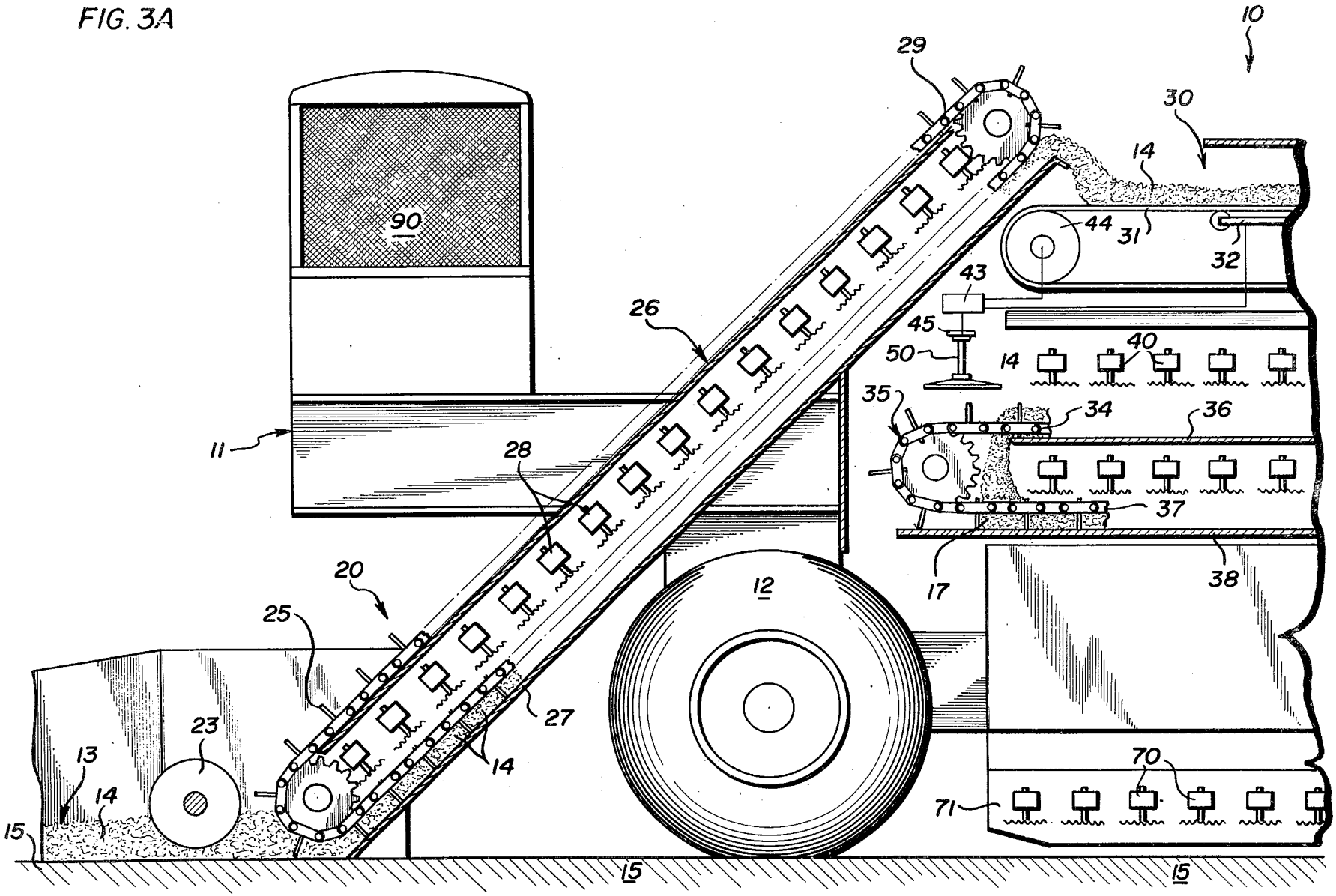
FIG. 3A is an enlarged elevational view showing, in somewhat schematic form, the front or fore-end of the apparatus shown in FIGS. 1 and 2.
Figure 3B:
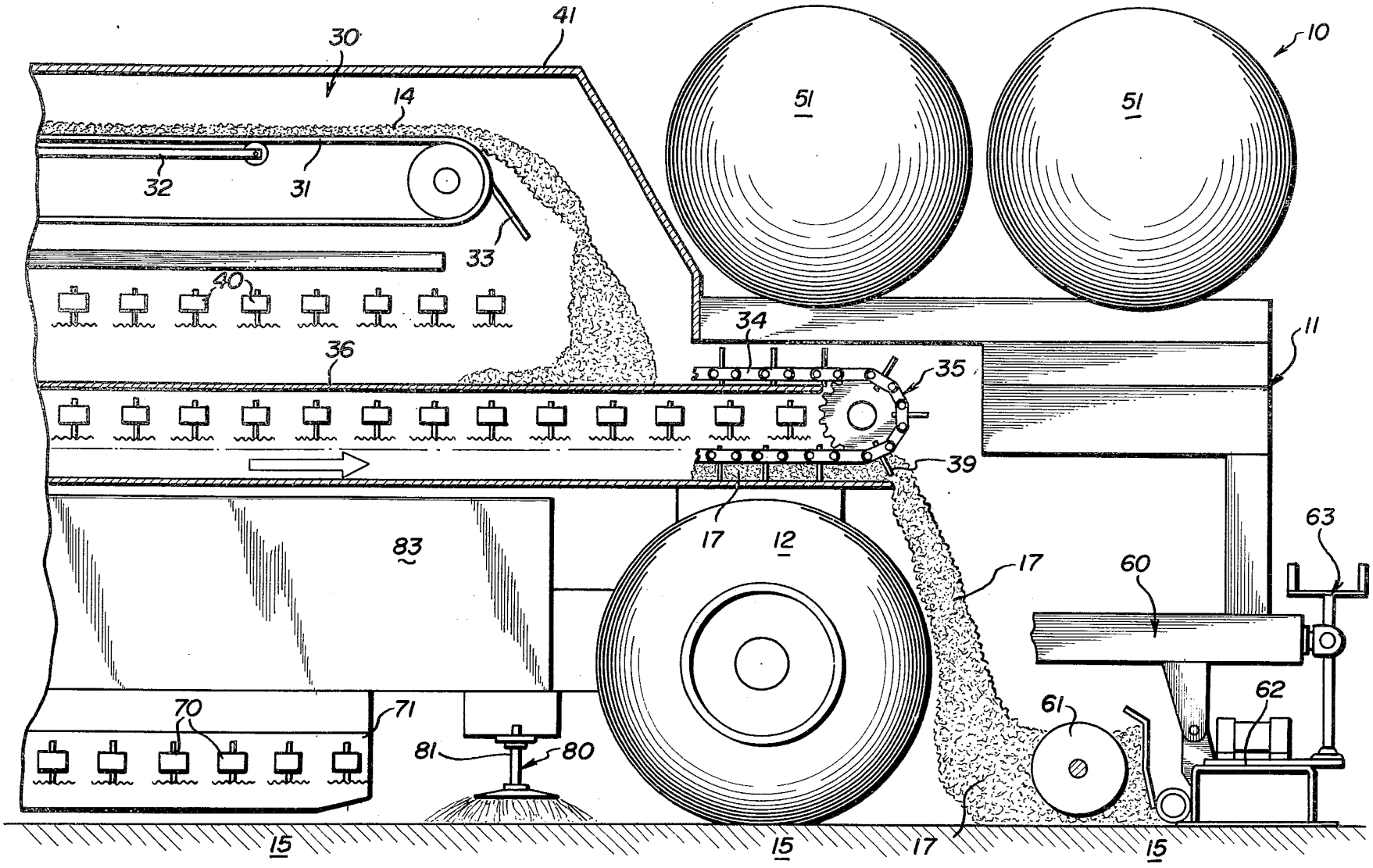
FIG. 3B is a side elevational view similar to FIG. 3A showing the rear portions of the apparatus shown in FIGS. 1 and 2.

At an aft or rear conveyor end 39, the heated material and asphalt mix is dropped upon the roadbed site 15 as illustrated particularly in FIGS. 2 and 3B. In this way, the crumbled pavement material and asphalt mix 17 is deposited back upon the roadbed site 15 in substantially the same place as that from which the crumbled pavement material 14 was picked up.

As the machine 10 travels along the roadbed site 15, the deposited mix 17 is next encountered by the spreader mechanism 60. Here, augers 61 distribute the mix 17 across the breadth of the roadbed work path and the preliminarily spread mix 17 is next encountered by screeds 62 for further spreading and preliminary compaction. Screed adjustment mechanism 63 precisely locates these screeds 62 in positions which insure the desired preliminary highway surface formation adapted for final working into a finished highway surface.

As indicated above, roadbed heaters 70 raise the surface temperature of the roadbed site 15 by directing radiant heat upon it as the machine 10 moves forward. An appropriately shaped hood 71 can be employed to confine the heat and direct it to desired portions of the roadbed site. Ducts 72 can be provided to draw away exhaust fumes. After the roadbed site is heated, the roadbed asphalt applicator 80, which can include a number of transversely disposed spray heats 81 (see FIG. 1), applies heated liquid asphalt to the roadbed site 15, as from a conveniently disposed and heated asphalt reservior tank 83.

The invention is claimed as follows:

1. Equipment for recycling macadam pavement, comprising pickup means for removing crumbled macadam pavement material from a roadbed site, first and second heater means for heating the removed and crumbled pavement material, transport conveyor means including a first conveyor reach for conveying crumbled pavement material in a first direction past the first heater means, drop area means for dropping the crumbled pavement material from the first conveyor reach, thereby tumbling and agitating the crumbled pavement material, and a second conveyor reach for conveying the crumbled, agitated pavement material in a second direction of travel opposite the first direction of travel in an extended serpentine path past the second heater means for further heating, applicator means located in the drop area means for applying liquid asphalt to the heated, tumbling crumbled pavement material in the drop area means, and spreader means for applying the crumbled pavement and asphalt mix to the original roadbed site.

2. Equipment according to claim 1 including roadbed heater means for heating the roadbed site from which crumbled pavement material has been removed so as to prepare the roadbed site for application of crumbled pavement and asphalt mix.

3. Equipment according to claim 1 including roadbed applicator means for applying liquid asphalt to the roadbed site from which crumbled pavement material has been removed so as to prepare the roadbed site for application of crumbled pavement and asphalt mix.

4. Equipment according to claim 1 wherein said pickup means includes gathering means for gathering crumbled pavement material from its roadbed site into a window.

5. Equipment according to claim 1 wherein said pickup means includes pickup conveyor means for conveying the crumbled pavement material from the roadbed site to an elevated position within said equipment.

6. Equipment according to claim 1 including sensor means for sensing the weight of crumbled pavement material passed through the equipment, and control means responsive to the sensor means and connected to said applicator means for controlling the amount of liquid asphalt applied to the heated, crumbled pavement material in response to the weight of crumbled pavement material passing through the equipment.

7. Equipment according to claim 1 wherein said transport conveyor means conveyor reaches are vertically arrayed, movement of crumbled pavement material from an elevated conveyor reach to a lower reach thereby tumbling and agitating the crumbled pavement material so as to encourage the liquid asphalt to completely cover the crumbled pavement material.

8. Equipment for recycling asphalt concrete pavement comprising a mobile frame, pickup means mounted upon the mobile frame for removing crumbled pavement material from a roadbed site, first and second heater means mounted upon the mobile frame for heating the removed and crumbled pavement material, transport conveyor means mounted on the mobile frame including a first conveyor reach for conveying crumbled pavement material in a first direction past the first heater means, drop area means for dropping the crumbled pavement material from the first conveyor reach, thereby tumbling and agitating the crumbled pavement material, and a second conveyor reach for conveying the crumbled, agitated pavement material in a second direction of travel opposite the first direction of travel in an extended serpentine path, applicator means mounted upon the mobile frame for applying liquid asphalt to the heated tumbling crumbled pavement material in the drop area means, and discharge means for discharging the heated crumbled pavement material and asphalt mix to the original roadbed site.

9. Equipment according to claim 8 including spreader means for applying the crumbled pavement and asphalt mix to the original roadbed site in a preliminary condition adapted for final working into a finished road.

10. Equipment according to claim 8 including roadbed heater means mounted upon said frame for heating the roadbed site from which crumbled asphalt pavement material has been removed so as to prepare the roadbed site for application of crumbled pavement and asphalt mix.

11. Equipment according to claim 8 including roadbed applicator means for applying liquid asphalt to the roadbed site from which crumbled pavement material has been removed so as to prepare the roadbed site for application of crumbled pavement and asphalt mix.

12. Equipment according to claim 8 including motor means for propelling said equipment along the roadbed.

13. A method of recycling a macadam road comprising the steps of crumbling at least the upper strata of said road at the roadbed site, picking up the crumbled pavement material from its roadbed site, heating the removed and crumbled pavement material while simultaneously conveying the material in a first direction, tumbling the material and simultaneously applying liquid asphalt to the heated, crumbled, tumbling pavement material, further heating the crumbled, tumbled pavement material and liquid asphalt mix while simultaneously conveying the material in a second direction opposite to the first direction, and spreading the crumbled pavement material asphalt mix upon the original roadbed site.

14. A method of recycling a macadam road according to claim 13 including the step of heating the roadbed site from which crumbled pavement material has been picked up prior to applying the crumbled pavement material and asphalt mix so as to encourage firm adhesion of the mix to the roadbed site.

15. A method of recycling a macadam road according to claim 13 including the step of applying liquid asphalt to the roadbed site from which crumbled pavement material has been picked up prior to applying the crumbled pavement material and asphalt mix so as to encourage firm adhesion of the mix to the roadbed site.

16. A method of recycling a macadam road according to claim 13 including the steps of weighing the picked up crumbled pavement material, and applying an amount of the liquid asphalt to the heated, crumbled pavement material in relation to the weight of the picked up crumbled pavement material.

17. A method of recycling a macadam road according to claim 13 including the step of gathering pavement material into a windrow prior to picking up the pavement material.

18. A method of recycling a macadam road at a roadbed site comprising the steps of crumbling at least the upper strata of said road at the roadbed site, picking up the crumbled pavement material from its roadbed site by a pickup means, heating the picked up crumbled pavement material by a heater means while simultaneously conveying the material in a first direction by a first conveyor reach, tumbling the material in a drop area means and simultaneously applying liquid asphalt to the heated, crumbled pavement material by an applicator means, further heating the crumbled, tumbled pavement material and liquid asphalt mix by a second heater means while simultaneously conveying the material in a second direction opposite to the first direction by a second conveyor reach and spreading the crumbled pavement material and asphalt mix upon the original roadbed site by a spreader means.

19. A method of recycling a macadam road according to claim 18 and including the step of heating the roadbed site from which crumbled pavement material has been picked up by a roadbed heater means while simultaneously heating the removed and crumbled pavement material and applying liquid asphalt to the heated crumbled pavement material.

20. A method of recycling a macadam road according to claim 18 further including the step of applying liquid asphalt to the roadbed site from which crumbled pavement material has been picked up by a roadbed applicator means simultaneously with the steps of heating the picked up and crumbled pavement material and applying liquid asphalt to the heated crumbled pavement material.

21. A method of recycling a macadam road according to claim 18 including the step of moving the pickup means, heater means, applicator means and spreader means over the roadbed site so as to spread the crumbled pavement material and asphalt mix on the roadbed site in substantially the same place as that from which the crumbled pavement material was picked up.

* * * * *

UNITED STATES PATENT AND TRADEMARK OFFICE

CERTIFICATE OF CORRECTION

PATENT NO. : 4,011,023

DATED : March 8, 1977

INVENTOR(S) : Earl F. Cutler

It is certified that error appears in the above-identified patent and that said Letters Patent are hereby corrected as shown below:

Column 4, line 44, "reservior" should be --reservoir--

Column 5, line 11, "window" should be --windrow--

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*